US011127541B2

(12) United States Patent
Hoffmann

(10) Patent No.: US 11,127,541 B2
(45) Date of Patent: Sep. 21, 2021

(54) ELECTROMAGNETIC SWITCH

(71) Applicant: Phoenix Contact GmbH & Co. KG, Blomberg (DE)

(72) Inventor: Ralf Hoffmann, Berlin (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 403 days.

(21) Appl. No.: 16/303,085

(22) PCT Filed: May 23, 2017

(86) PCT No.: PCT/EP2017/062329
§ 371 (c)(1),
(2) Date: Nov. 19, 2018

(87) PCT Pub. No.: WO2017/202803
PCT Pub. Date: Nov. 30, 2017

(65) Prior Publication Data

US 2019/0304712 A1 Oct. 3, 2019

(30) Foreign Application Priority Data

May 24, 2016 (DE) ..... 10 2016 109 486.2

(51) Int. Cl.
*H01H 3/00* (2006.01)
*H01H 50/54* (2006.01)
(Continued)

(52) U.S. Cl.
CPC ..... *H01H 3/001* (2013.01); *H01H 3/02* (2013.01); *H01H 9/0066* (2013.01); *H01H 15/102* (2013.01); *H01H 50/541* (2013.01); *H01H 50/60* (2013.01); *H01H 50/641* (2013.01); *H01H 51/229* (2013.01); *H01H 2221/064* (2013.01); *H01H 2225/014* (2013.01)

(58) Field of Classification Search
CPC ..... H01H 15/102; H01H 2221/064; H01H 2225/014; H01H 3/001; H01H 3/02; H01H 50/541; H01H 50/60; H01H 50/641; H01H 51/229; H01H 9/0066
See application file for complete search history.

(56) References Cited

U.S. PATENT DOCUMENTS 4,841,109 A * 6/1989 Sakakino ..... H01H 15/005 200/302.1
4,851,625 A * 7/1989 Liebich ..... H01H 15/005 200/551
2015/0042423 A1 2/2015 Hoffmann et al.

FOREIGN PATENT DOCUMENTS

CN 104221120 A 12/2014
DE 42 43 607 A1 7/1993
(Continued)

*Primary Examiner* — Bernard Rojas
(74) *Attorney, Agent, or Firm* — Holland & Hart LLP

(57) ABSTRACT

The disclosure relates to an electromagnetic switch, comprising: an armature; a slider configured to manually move to actuate the armature; and a deformable force transfer element positioned between the slider and the armature, wherein the slider is configured to be pressed against the deformable force transfer element to actuate the armature with a press force, and wherein the deformable force transfer element is configured to deform when a press force threshold value is exceeded to limit a transferable force from the slider onto the armature.

18 Claims, 5 Drawing Sheets

(51) Int. Cl.

| | |
|---|---|
| ***H01H 9/00*** | (2006.01) |
| ***H01H 3/02*** | (2006.01) |
| ***H01H 50/64*** | (2006.01) |
| ***H01H 50/60*** | (2006.01) |
| ***H01H 15/10*** | (2006.01) |
| ***H01H 51/22*** | (2006.01) |

(56) References Cited

FOREIGN PATENT DOCUMENTS

| | | | |
|---|---|---|---|
| DE | 102 39 284 | A1 | 4/2003 |
| DE | 10 2008 026761 | A1 | 12/2008 |
| DE | 10 2012 006 450 | A1 | 10/2013 |
| DE | 10 2012 006438 | A1 | 10/2013 |
| DE | 100 27 361 | C1 | 10/2013 |
| EP | 0 131 304 | A2 | 1/1985 |
| FR | 2 349 942 | A1 | 11/1977 |
| JP | 196-203383 | A | 8/1996 |
| JP | 2015511762 | A | 4/2015 |
| SU | 1 024 994 | A2 | 6/1983 |

* cited by examiner

ELECTROMAGNETIC SWITCH

CROSS-REFERENCE TO RELATED APPLICATIONS

This application is a 371 national phase filing of International Application No. PCT/EP2017/062329, entitled "ELECTROMAGNETIC SWITCH", filed 23 May 2017, which claims priority to German Patent Application No. 10 2016 109 486.2, entitled "ELEKTROMAGNETISCHER SCHALTER", filed 24 May 2016.

BACKGROUND

The present disclosure concerns an electromagnetic switch.

Electromagnetic switches, which are implemented as relays for example, include as a rule an armature that can be implemented as a rocker armature. A lever can be used for manual actuation of the armature, the said lever changing the position of the armature so that the contact springs coupled to the armature perform a switching movement and the contacts of the relay can be opened or closed.

However, in the event of a fault, for example at higher currents, temporary welding of the contacts can occur. Manual actuation of the lever can lead to damage of the contact springs in the relay in such a case. A solution to this problem is proposed in DE 102012006438 by increasing the contact areas in the relay, thus reducing the probability of welding between the contacts.

SUMMARY

The object of the present disclosure is to create a design for avoiding damage in a fault case to an electromagnetic switch of the aforementioned type.

This object is solved by the characteristics of the independent Claim 1, Advantageous examples of the disclosure are subject matter of the figures, of the description and of the dependent claims.

The disclosure is based on the knowledge that the above object can be solved by limiting the forces which can be transferred from a switch to an armature of an electromagnetic switch, for example a relay. This can prevent especially a plastic deformation of components of the electromagnetic switch, of contact springs for example, for welded contacts for example.

According to a first aspect of the disclosure, the object is solved by an electromagnetic switch that has an armature and a slider that is manually slidable for actuating the armature. Furthermore, the disclosure-related electromagnetic switch has a deformable force transfer element that is positioned between the slider and the armature. The slider is pressable with a pressing force against the deformable force transfer element by manual actuation in order to actuate the armature. The slider exerts here forces on the force transfer element, the latter transferring these to the armature. With this, the armature can be actuated manually from outside via the slider. The deformable force transfer element is deformed by the press force on exceeding a press force threshold. This limits the transferable press force from the slider onto the armature.

An alternative to a slider for manual actuation is another actuating element, for example a press switch or a lever, insofar that this is suitable, that can transfer the force applied to the force transfer element by an operator. If the force applied by the operator on the slider exceeds a certain threshold, the force transfer element deforms and, due to its deformation, ensures that the force transferred to the armature by the force transfer element does not exceed the threshold value. The threshold value is so selected that it does not yet produce a plastic deformation of components, contact springs of a relay for example, and so does not lead to permanent damage of the components, if for example contacts of the switch are welded together and the user attempts to separate the contacts manually. The threshold value can for example be so selected that it corresponds to the force that a magnetic system of the electromagnetic switch, also taking an excitation into account, would also exert on the armature.

The limiting of the press force due to deformation of the force transfer element on exceeding the threshold value is invoked. Even low forces can cause a certain deformation of the force transfer element, but do not lead to a limiting of the press force. It is therefore always ensured that the forces transferred by the force transfer element to the armature are at least large enough so that the contacts of the switch can be opened and closed in the fault-free condition of the electromagnetic switch. The press force in the disclosure-related electromagnetic switch can also increase during the deformation of the force transfer element and has then reached its maximum travel when the slider is moved by the operator and then reach the force threshold value, so ensuring that the press force threshold value is not exceeded over the entire travel path of the slider and is independent of the forces exerted on the slider.

An electromagnetic switch configured within the meaning of the disclosure is especially characterised by the fact that forces applied by the operator via the slider or another actuating element on the other components of the electromagnetic switch are so limited by design that permanent damage to components, e.g. contact springs of the electromagnetic switch, is effectively prevented.

According to a further advantageous form of the disclosure, a provision is made to connect the deformable force transfer element to the armature. This can take place as materially bonded or frictionally connected. A form-locking engagement between the force transfer element and the armature is also possible. The force transfer element can for example be riveted, screwed, bonded, soldered or welded to the armature. This prevents the force transfer element changing its position relative to the armature and also relative to slider and causing malfunctions or functional failures.

The armature of the electromagnetic switch can be a rocker armature, but also another type of armature, e.g. a hinged armature.

According to a further advantageous form of the disclosure, the deformable force transfer element can be deformed plastically or elastically. Here, the degree of deformability can be influenced on the one hand by the choice of material; but especially on the other hand by the geometric design of the force transfer element. The deformation of the force transfer element in the case of an elastic force transfer element is reversible, even when forces applied over the entire travel path of the slider exceed the press force threshold value. The forces applied by the operator do not then lead to a permanent deformation of the force transfer element. The effected limiting of the applied forces by the force transfer element on the press force threshold value is therefore possible, even with multiple operator errors, in which large forces are exerted on the slider. Damage to the force transfer element does not occur.

If the force transfer element, on the other hand, is plastically deformable, even a one-off manual operation in which the press force threshold value is exceeded leads to a permanent deformation of the force transfer element so that in a repeated manual operation, either a limitation of the press force by the force transfer element on the press force threshold value is not ensured, or with a manual operation, the forces are no longer adequate to open or close the contacts of the electromagnetic switch.

In a further advantageous example, the deformable force transfer element has a deformable tongue. The electromagnetic switch is so designed that the slider can be pressed against the deformable tongue. The deformable tongue can be deformed in order to absorb the press force of the slider when the press force threshold value is exceeded. By deforming the tongue, the force exerted by the slider on the tongue can be so reduced that the tongue exerts a force on the armature that is not greater than the press force threshold value. The tongue can have various designs, for example, it can be triangular are or wave-shaped, wherein the triangle or the wave is preferably pointing from the armature in the direction of the slider. The tongue can have a flank, against which the moving slider can come to rest so that the slider can exert force on the tongue to move the armature via the flank.

In a further advantageous example, the deformable force transfer element comprises a circumferential frame to which the armature is attached. A window is formed in the circumferential frame in this example. The deformable tongue is attached on one side to the circumferential frame and, in deformation of the deformable force transfer element, the tongue can be taken up (at least partly) by the window. In this, tongue and frame can be designed as monoblock parts. The circumferential frame can have a section where the deformable tongue is fixed to the frame by means of which the force transfer element can be attached to the armature. In the plan view of the force transfer element, the tongue can be completely surrounded by the frame in its projection.

In a further advantageous example, the deformable tongue formed by a partial circumferential slit into a material part. In this, the circumferential frame surrounds the partial circumferential slit. The tongue is therefore cut free from the material part by the slit. The tongue can protrude from a plane of the material part, for example in wave shape, triangular shape, or even curved shape, so that the slider can come to a stop in its movement along the tongue in order to transfer these forces. The tongue can for example be made by punching out from a material part wherein the circumferential frame and the partial circumferential slit are also obtained from the punching out. Das punching can be preferably carried out on only one section of the material piece so that the material piece has a further section in which no slit is present and that the tongue and frame are fixed to this further section and the force transfer element can be attached to the armature by means of this further section. After the punching out of the tongue from an initially flat piece of material, the tongue can protrude from the plane of the piece of material after the subsequent deformation, in the form of a triangle or wave as described above, and the circumferential frame can be prestressed by applying forces so that the press force threshold value can be adjusted by the prestressing, amongst other things.

In a further advantageous example, the deformable tongue is in the form of a wave. It is so designed and positioned between the slider and the armature that a wave flank of the deformable tongue is contacted by the slider. As already described above, other geometrical forms, e.g. triangular form or a semicircular form, are possible for the tongue, which allow forces exerted by the operator on the slider to be transferred to the tongue. When the slider is moved by the user, a flank of the slider comes to rest at the deformable tongue and transfers forces to the deformable tongue, the said forces—at least when the press force threshold value is exceeded—then lead to a deformation of the tongue. Because of the tongue's elasticity, a certain deformation can however already occur before the press force threshold value is exceeded.

In an advantageous example of the disclosure, the press force threshold value is dependent on the geometrical form of the tongue. The properties of the tongue depend on its geometric shape. For example, the stiffness of the tongue on the one hand depends on the thickness of the material, but especially also on the design of tongue. Various stiffnesses can be achieved by the use of different designs. The tongue can also be fitted with stiffeners or cutouts to reduce the elasticity of the tongue. i.e. make the tongue stiffer, or increase elasticity of the tongue, i.e. reduce its stiffness, whereby the press force threshold value is reduced.

In a further advantageous example, the deformable force transfer element is so designed that it transfers a press force from the slider to the armature as long as the press force does not exceed the press force threshold value. The armature is actuated for this. A force that exceeds the press force threshold value is only transferred from the slider to the armature at the level of the press force threshold value.

In an especially advantageous example, the electromagnetic switch has an electromechanical contact. One or more electromechanical contacts can be provided here. The electromechanical contact can be freely released in the non-locked contact state, i.e. when the contacts are either not mechanically locked together or especially when not welded together. The electromechanical contact can be released by the armature by exerting a releasing force. The releasing force is exerted on the contact directly by the armature or via intermediate elements, wherein the releasing force is formed by the force transferred via the deformable force transfer element on the armature. The force transferred by the force transfer element is formed from the force applied by the operator on the slider that the slider then applies to the force transfer element. The press force threshold value is greater than the release force so that a deformation of the force transfer element that would lead to a limiting of the press force to the press force threshold value does not do that as the press force is limited to a value that is lower than the release force that is to be applied to release the contact. This ensures that the contacts, if not locked, e.g. not welded, can always be released manually from each other by means of the slider or, in another example, can also be closed. If there are several contacts present, a contact can be opened by the actuation of the slider while another contact is simultaneously closed. This is for example the case when the contacts are positively driven so that the opening of a contact always leads to closing of one of the other contacts and vice versa.

In an especially advantageous example, the deformable force transfer element is so designed that when at least one electromechanical contact is in a locked state, for example is welded due to overcurrent, the electromechanical contact cannot be released by the user actuating the slider. The deformable force transfer element deforms when the force applied exceeds a press force threshold value. The press force threshold value is so selected that a release of locked, especially welded, contacts by the forces exerted on the slider is not possible. This prevents the components of the electromagnetic switch being plastically deformed by the slider forces applied via the force transfer element on the armature, and leading to irreversible deformation of components and so to permanent damage of the electromagnetic switch. For example, this prevents contact springs of the electromagnetic relay being irreversibly bent, so damaging the relay and possibly making it unusable. The deformable force transfer element is so designed that it limits the press force to a press force threshold value so that the press force threshold value is lower than the force that would lead to plastic deformation of components, for example contact springs, of the electromagnetic switch so that the forces transferred to the armature can never lead to a plastic deformation, and so never to damage of electromagnetic switch components.

In an especially advantageous example, the deformable force transfer element is so designed that a break in the slider due to mechanical overloading is prevented. The forces transferred by the deformable force transfer element onto armature are so limited by the design of the deformable force transfer element that they cannot exceed the forces which would result in damage to the slider.

In a further advantageous example, the deformable force transfer element is implemented as a single piece. In the example described above with frame and tongue, frame and tongue for example are manufactured by punching from a single piece of material; in the same way, a section of the force transfer element that can be used to attach the force transfer element to the armature. The tongue and also the frame can be so geometrically designed that a desired press force threshold value can be set. The one-piece force transfer element is preferably formed here from metal, spring steel for example. The force transfer element can for example be implemented as a leaf spring. The press force threshold value can be influenced by the pre-stressing of the force transfer element.

In a further advantageous design, the electromagnetic switch is implemented as a relay. The relay in this has, disclosure-related, a slider, a force transfer element for transferring the forces of the slider to an armature, as well as the armature. The armature is so designed that a movement of the armature leads to opening or closing of one or more contacts. The opening or closing of at least one contact can still occur via further intermediate elements between armature and contact, for example intermediate lever and contact springs. In the implementation of the electromagnetic switch as relay, the press force threshold value is so defined that the forces applied by the force transfer element on the armature and then from that onto further components, e.g. contact springs are not sufficient to plastically deform further components, for example when a user attempts to loosen welded-together contacts by means of the slider, so that damage to the relay from too large forces exerted by the operator can be prevented.

In a further advantageous example, especially when the electromagnetic switch is designed as a relay, the electromagnetic switch has at least two contacts wherein the contacts are positively driven. An opening of a contact therefore leads inevitably to the closing of the other contact. This ensures that a plastic deformation of the components of the electromagnetic switch is prevented by limiting the press force, that the positively driven operation of the contacts is not cancelled by unallowably heavy deformation of components, contact springs for example. This ensures that, because of the positively driven operation, the state of a contact. i.e. open or closed, the state of the other contact that is antivalent to the state of the first contact, can be uniquely determined.

BRIEF DESCRIPTION OF THE DRAWINGS

Examples of the present disclosure are described in the following with the help of the accompanying drawings.

DETAILED DESCRIPTION

Figure 1:
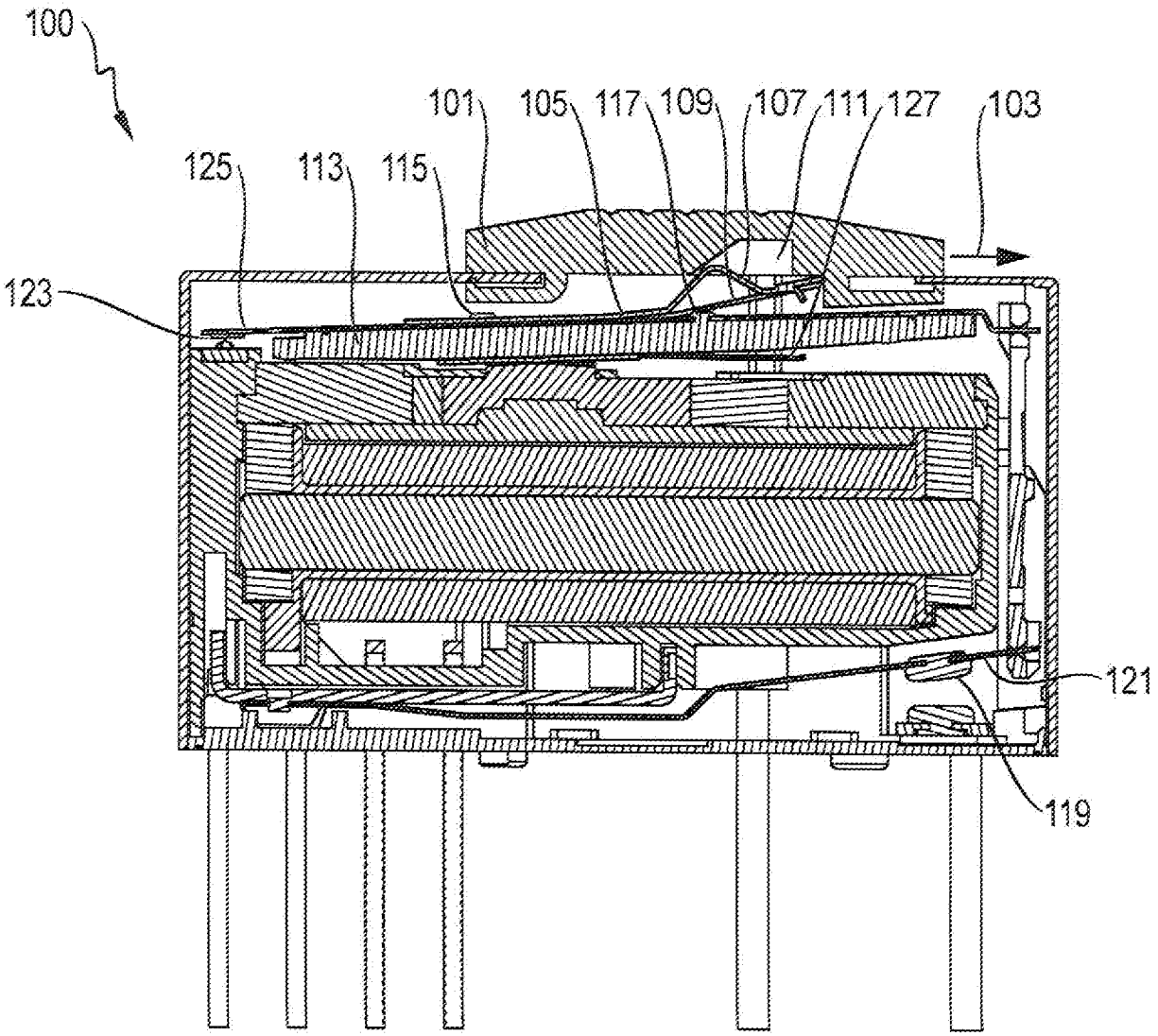
FIG. 1 shows an electromagnetic switch with non-actuated slider implemented as a relay.

FIG. 1 shows a disclosure-related electromagnetic switch 100 that is realised as a relay. FIG. 1 shows the slider 101 with which the contacts 119, 123 of the relay can be manually actuated, in a non-actuated position. The normally open contact 119 is open here, while the normally closed contact 123 is closed. The normally open contact 119 can be closed manually by moving the slider 101 in the actuation direction 103, wherein the normally closed contact 123 is opened. In the example shown in FIG. 1, the normally open contact 119 and the normally closed contact 123 positively driven so that a closing of the normally open contact 119 always leads to an opening of the normally closed contact 123.

In the non-actuated state of the slider 101, the tongue 107 of the deformable force transfer element 105 lies in a recess 111 in the slider 101 so that no forces are applied to the tongue 107 of the force transfer element 105 via slider 101. This also means that no forces are exerted on the armature 113 by the force transfer element 105 when the slider 101 is not actuated. Forces are therefore also not exercised on the contact spring 121 of the normally open contact by the armature in this condition so that the normally open contact 119 is open. A return spring 127 together with a magnetic restoring torque ensure that the armature 113 is always in a position in which the normally closed contact 123 is closed when no further electromagnetic or manual forces are exerted on the armature.

In the example of the electromagnetic switch shown in FIG. 1, the deformable force transfer element is illustrated as force transfer element with a tongue 107 and a frame 109. The structure of this deformable force transfer element 105 is described below in more detail in the FIGS. 4 and 5.

The deformable force transfer element 105 in FIG. 1 is fixed to the armature 113 using attachment elements 115. In the example of FIG. 1, the deformable force transfer element 105 is attached to the armature 113 using rivets. Other types of joints are however possible, for example bonding, welding or soldering.

The armature 113 in the example of FIG. 1 is designed as a rocker armature. Other examples of an armature can however also be used, e.g. a hinged armature.

In addition to a manual actuation via the slider 101, the electromagnetic switch 100 in the example of FIG. 1 can also be actuated electromagnetically in the known way. However, this should not be gone into further here.

Figure 2:
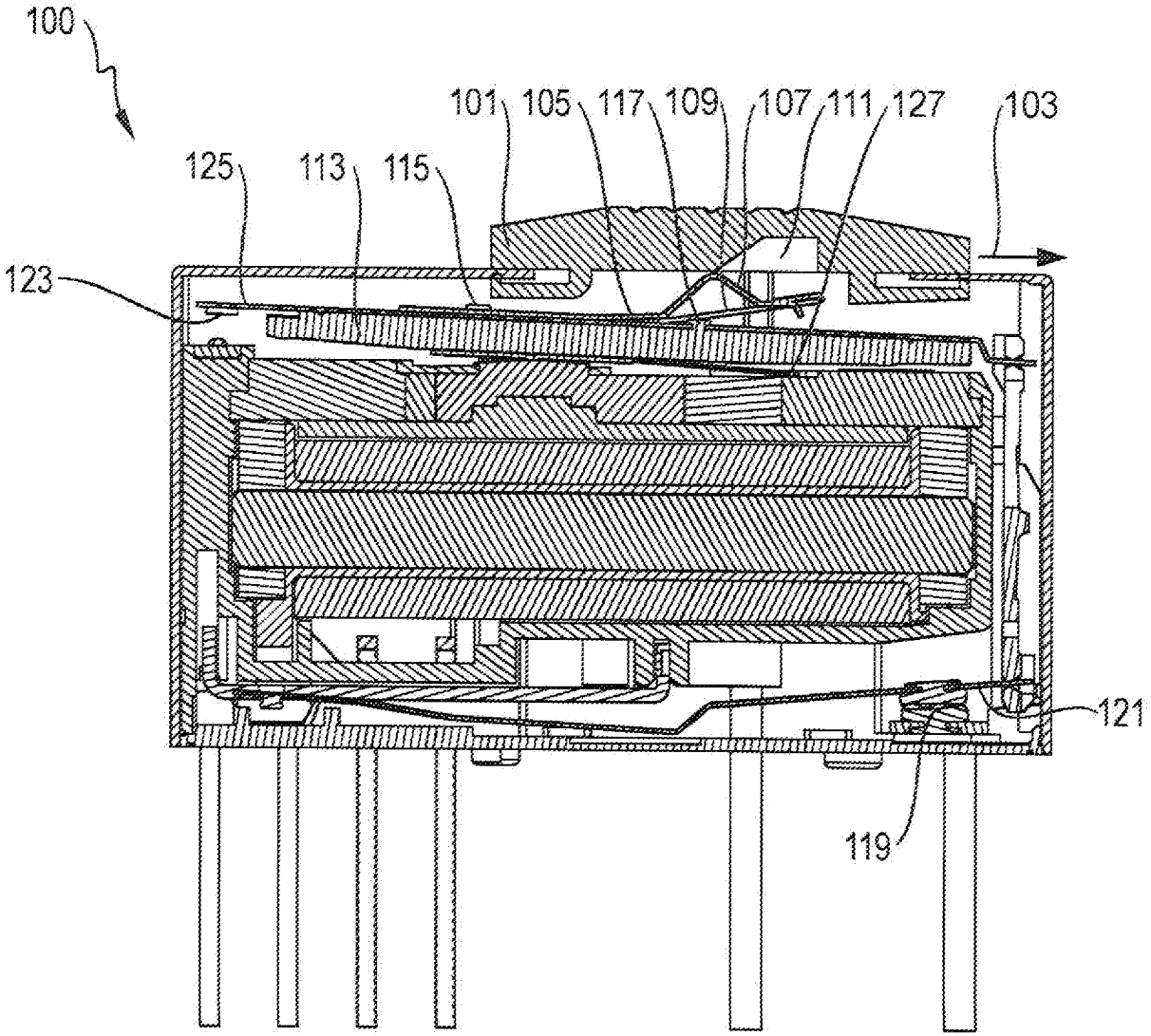
FIG. 2 shows the electromagnetic switch from FIG. 1 designed as a relay in fault-free condition with actuated slider.

The manual actuation of the electromagnetic switch 100 as relay example from FIG. 1 occurs in that the slider 101 is moved by the operator in the actuation direction 103. This closes the normally open contact 119, while the normally closed contact 123 is opened. In FIG. 2, the electromagnetic switch implemented as relay is shown in a state in which the normally open contact 119 is closed, while the normally closed contact 123 is open. Also shown here, as in FIG. 1, is a fault-free condition, i.e. neither the normally open contact 119 nor the normally closed contact 123 are welded together.

In the state shown in FIG. 2, the slider 101 is moved in the actuation direction 103 to close the normally open contact 119 and open the normally closed contact 123. Forces are applied to the tongue 107 of the deformable force transfer element 105 by a flank in the recess 111 of the slider 101, that can be transferred by the deformable force transfer element 105 to the armature 113. In the state shown in FIG. 2 in which the normally open contact 119 is closed, the slider 101 has not yet been brought to a mechanical end stop in the actuation direction 103. The slider 101 is however already so far moved in the actuation direction that the tongue 107 of the deformable force transfer element 105 has completely left the recess 111 of the slider 101.

In the slider 101 position shown in FIG. 2, the force applied by the operator to the slider 101 is transferred to the armature 113 via the tongue 107. The armature 113 then transfers the force via intermediate elements to the contact spring 121 of the normally open contact 119, the said spring deforming elastically under the effect of the force and leading to a closing of the normally open contact 119. The normally closed contact 123 is opened simultaneously.

As already described above, the deformable force transfer element 105 in the example shown has a tongue 107 via which the force exerted by the user on the slider 101 is transferred to the deformable force transfer element. The deformable force transfer element 105 also has a frame 109. Such an example of a deformable force transfer element 105 is described below in the explanations of FIGS. 4 and 5.

In the state shown in FIG. 2, the frame 109 of the deformable force transfer element 105 lies on a protrusion 117 of the armature 113. The protrusion 117 limits the movement of the frame 109 of the deformable force transfer element 105 relative to the armature 113. On the other hand, the movement of the tongue 107 of the force transfer element 105 relative to the armature 113 is not limited. The tongue 107 and the frame 109 of the deformable transfer element 105 can therefore move relative to each other. In the state shown in FIG. 2 however there is no, or very slight, relative movement of the tongue 107 of the deformable force transfer element 105 relative to the frame 109.

For the position of the slider 101 shown in FIG. 2, forces are applied on the one hand to the armature 113, which are transferred from the slider 101 via the tongue 107 of the force transfer element 105 onto the armature. These forces lead to closing of the normally open contact 119 and to opening of the normally closed contact 123. The return spring 127 deforms and exercises a restoring force on the armature 113 simultaneously due to the movement of the armature 113, which in turn leads to resetting of the armature 113 by moving the slider 101 against the actuation direction 103 and with that to an opening of the normally open contact 119 and to closing of the normally closed contact 123.

Figure 3:
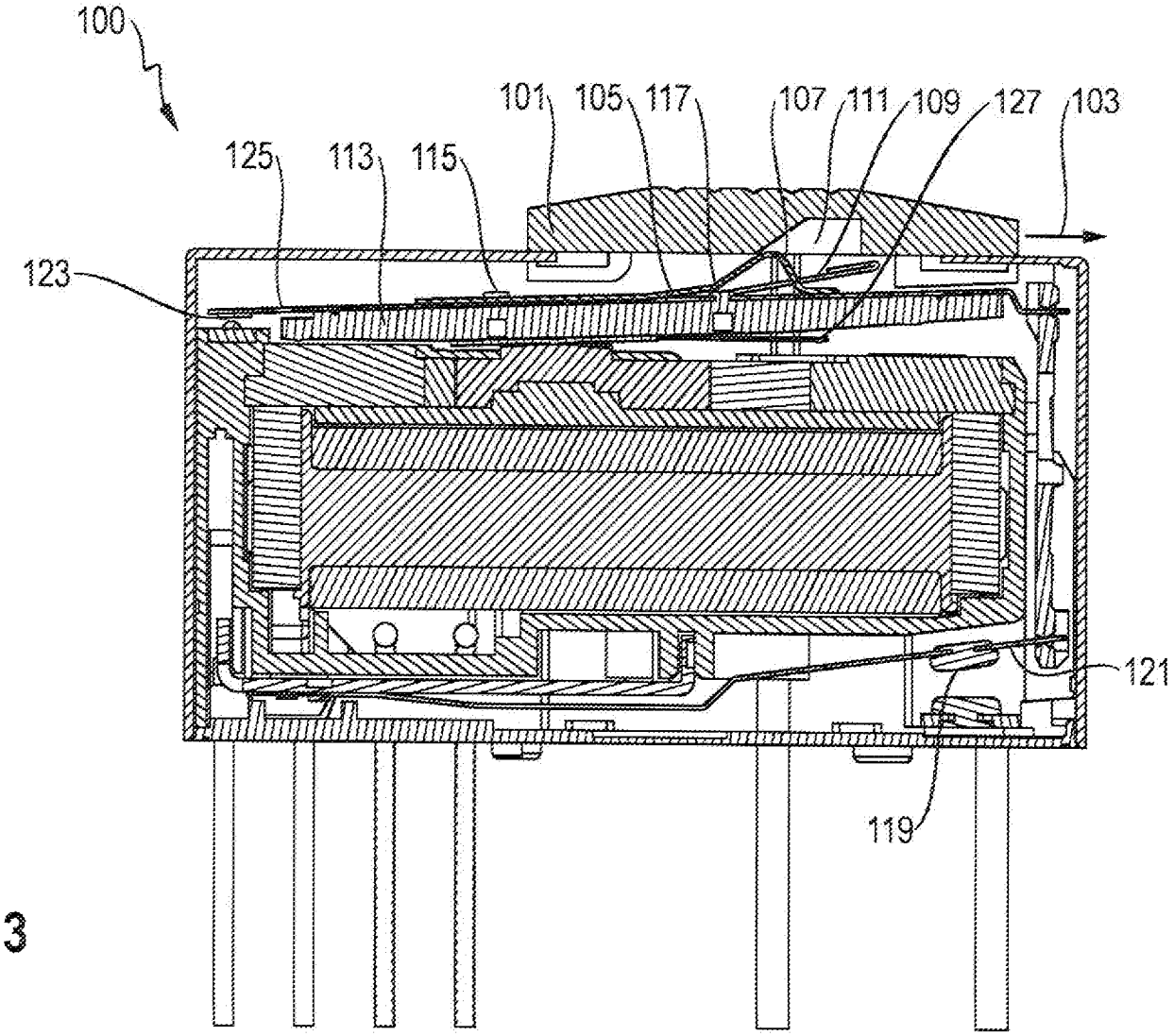
FIG. 3 shows the electromagnetic switch from FIG. 1 designed as a relay with actuated slider with welded normally closed contact.

FIG. 3 shows switch 100 of FIG. 1 implemented as a relay in a faulty condition. In the condition shown in FIG. 3, the normally closed contact 123 is welded, caused for example by overcurrents. This causes the normally open contact 119 to open and cannot be closed by electromagnetic actuation. The armature 113 is correspondingly located at a position that corresponds largely to the position of the non-actuated electromagnetic switch 100.

In the condition shown in FIG. 3, the slider 101 has been moved in the actuation direction 103 by the operator till it has almost reached a mechanical stop, as it has attempted to actuate the faulty relay in order to close the normally open contact 119 and open the normally closed contact 123. In this state, there is a danger that the user exerts force on the slider 101 which results in the contact spring 125 of the normally closed contact being plastically deformed and permanently damaged if the user attempts to loosen the welded, normally closed contact. This would damage the relay and the positively driven operation between normally closed contact 123 and normally open contact 119 would be eliminated. This is prevented however by the disclosure-related example of the electromagnetic switch 100 due to the deformation of the deformable force transfer element 105.

In the condition shown in FIG. 3, the movement of the frame 109 of the deformable force transfer element 105 relative to the armature 113, already explained with FIG. 2, is limited by the protrusion 117 of the armature 113. The movement of the frame 109 of the deformable force transfer element 105 relative to the armature 113 is therefore limited, regardless of how great the force exerted by the user on the slider 101 is. The force exerted by the user on the slider 101 leads however to the tongue 107 of the deformable force transfer element 105 moving relative to the frame 109 of the force transfer element 105. The tongue 107 moves relative to the armature 113 and then still further, when the movement of the frame 109 is already limited by the protrusion 117. The force transferred by the deformable force transfer element 105 on the armature 113 is limited by the relative movement or bending between frame 109 and tongue 107 of the deformable force transfer element 105. The force exerted here on the armature 113 via the tongue 107 and the frame 109 is determined by the relative bending between the tongue 107 and frame 109 as well as the spring constant. i.e. the elasticity at the joint between frame 109 and tongue 107. With increasing relative bending g between frame 109 and tongue 107 of the deformable force transfer element 105, the force exerted on the armature 113 via the tongue 107 and the frame 109 increases. It reaches its limit value when the slider 101 is so moved in the actuation direction that the tongue 107 contacts outside the recess 111, i.e. the tip of the tongue 107 contacts the underside of the slider 101 outside the recess 111 and the tongue 107 has so reached the state of its maximum bending relative to the further sections of the deformable force transfer element 105, especially relative to the frame 109. The maximum transferable force via the tongue 107 onto the armature 113 is therefore limited by the bending of the tongue 107 relative to the frame 109 and the bending of the tongue 107 relative to the armature 113 together with the elasticities, i.e. the spring constants of the connection between tongue 107 and frame 109 and between tongue 107 and the further sections of the deformable force transfer element 105. In the example of FIGS. 1 to 3, a movement of the slider 101 in the actuation direction 103 on the other hand does not lead to significant deformation of the tongue 107. The tongue 107 is only deformed in the section in which it has a connection to frame 109 and to the remaining section of the deformable force transfer element 105. There are however examples conceivable with which a deformation of the tongue 107 itself also takes place, for example a flattening of a triangular tongue, so that the deformation of the tongue 107 itself effects a limiting of the forces transferred via the tongue 107 to the armature 113. This can be achieved for example by reducing the stiffness of the tongue (107).

The deformable force transfer element 105 is so designed in its geometry and elasticities that the maximum force transferred from slider 101 via the deformable force transfer element 105 to the armature 113 is smaller than the force that would lead to a plastic, i.e. permanent, deformation of the contact spring 125 of the normally closed contact 123. In other words, before a plastic deformation of the contact spring 125 of the normally closed contact 123 occurs, the forces that would be necessary for this are limited by an elastic deformation of the tongue 107 relative to the frame 109 of the deformable force transfer element 105. The deformable force transfer element 105 and especially its frame 109, is itself prestressed in the example shown in FIGS. 1 to 3 in that it has been bent. The pre-stressing also influences the press force threshold value and sets a defined value of the force limiting.

In the example shown in FIGS. 1 to 3, the normally open contact 119 can be closed manually by actuating the slider 101. According to the disclosure, examples are however also possible in which the normally closed contact 123, instead of the normally open contact 119, can be opened by a manual actuation, or an opening and closing of a normally open contact as well as of a normally closed contact by manual actuation is possible. One or more sliders can be provided for this as well as several deformable force transfer elements arranged between sliders and armatures so that for example where only one slider in each slider direction takes effect against the flanks, one of two deformable force transfer elements positioned on an armature takes effect in each case.

Figure 4:
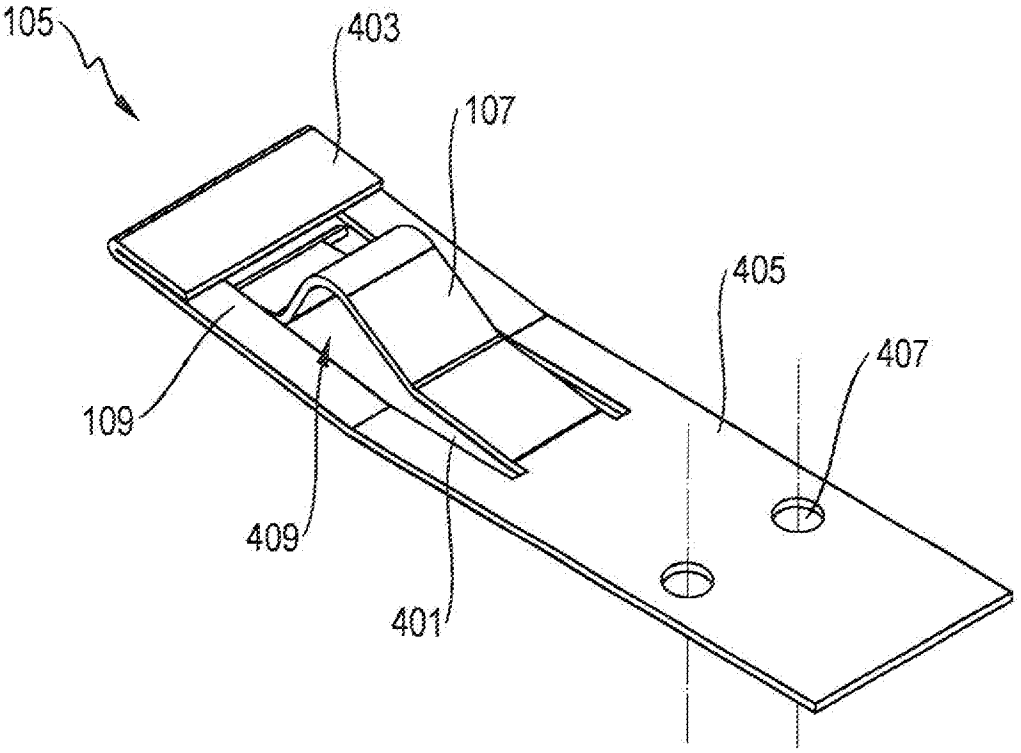
FIG. 4 shows a deformable force transfer element.

FIG. 4 shows a deformable force transfer element 105, as used in the example of the electromagnetic switch 100 according to FIGS. 1 to 3. The deformable force transfer element 105 shown here uses the leaf spring principle. In a rear section 405, the force transfer element 105 can be attached to the armature 113. Fixing holes 407 are provided for this in the example shown, for screwing or riveting the force transfer element 105 to the armature 113. It is however also possible to attach the force transfer element 105 to the armature 113 by bonding, soldering or welding.

A tongue 107 is formed on the force transfer element 105, the former being surrounded by a frame 109. Frame 109 and tongue 107 are joined together at the transition in the rear section 405 of the force transfer element 105. The tongue 107 is so formed that it protrudes from the plane spanned by the force transfer element 105. The tongue in the installed condition thus protrudes in the direction of slider 101 so that when the slider 101 moves in the actuation direction 103 due to the slider 101, forces can be exerted on the flank of the tongue 107.

A slit 401 is formed between frame 109 and tongue 107 that enables the movement of the tongue 107 relative to the frame 109. The slit 401 surrounds a window 409 in which the tongue 107 is positioned and in which the tongue 107 can move relative to frame 109 when forces are applied.

The force transfer element 105 is folded in a front section 403, which reduces the window 409 for the movement of the tongue 107 so that the front section 501 of the tongue 107 (see FIG. 5) lies below the front section 403 of the force transfer element 105, which limits the movement of the tongue 107 relative to the frame 109 in the direction of the slider 101 when installed in the switch 100, i.e. the tongue with its front section 501 cannot move above the frame. This prevents the tongue 107 being able to move on the side of the frame 109 facing the slider 101.

The deformable force transfer element 105 is internally prestressed, i.e. the section of the force transfer element 105 in which the tongue 107 and the frame 109 are arranged is prestressed or bent up in the direction of the slider, protruding from the plane of the section 405 in which the force transfer element 105 is fixed to the armature in the installed condition. The degree of prestressing here influences the amount of the force transferred from slider 101 to the armature 113 via the tongue 107 and the frame 109.

Figure 5:
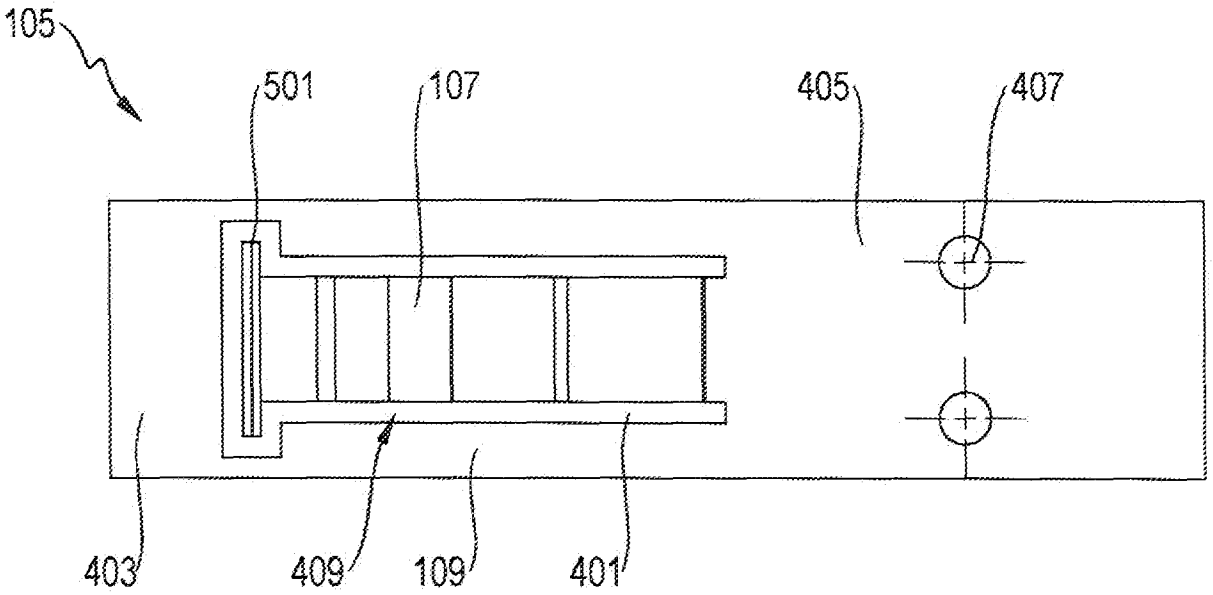
FIG. 5 shows the deformable force transfer element from FIG. 4 after a first manufacturing step.

FIG. 5 shows the deformable force transfer element 105 according to FIG. 4 following a first manufacturing step in which a slit 401 has been punched out from a single piece of material resulting in the formation of frame 109 and tongue 107. The tongue 107 has a front, widened section 501 that, as mentioned above, forms the movement of the tongue 107 in the direction of the slider, i.e. upwards limited, in that it forms a stop, that strikes against the front section 403 of the deformable force transfer element 105 when the front section 403 has been folded as shown in FIG. 4 and so that the section of the slit 401 or of window 409, facing the front section 501 of the tongue 107 is covered so that the tongue 107 there cannot move through the slit 401 or the window 409 that is formed by means of the slit 401 in the force transfer element 105.

In the manufacturing step shown in FIG. 5, the holes 407 for attaching the force transfer element 105 to the armature are already made. In the further, subsequent manufacturing steps, the force transfer element 105 is still prestressed by the deforming of the frame 109, the tongue 107 is bent and the front section 403 is folded, as shown in FIG. 4, to form a limit for the movement of the tongue 107. The force transfer element 105, according to FIG. 4, is preferably made of metal, spring steel for example. However, it also can be manufactured from other materials with suitable elastic properties.

LIST OF REFERENCE NUMBERS

100 Electromagnetic switch
101 Slider
103 Actuation direction
105 Deformable force transfer element
107 Tongue
109 Frame
111 Recess
113 Armature
115 Attachment element
117 Protrusion
119 Normally open contact
121 Contact spring of the normally open contact
123 Normally closed contact
125 Contact spring of the normally closed contact
127 Return spring
401 Slit
403 Front section of the force transfer element
405 Rear section of the force transfer element
407 Attachment holes
409 Window
501 Front section of the tongue

What is claimed is:

1. An electromagnetic switch, comprising:

an armature;

a slider configured to manually move to actuate the armature; and a deformable force transfer element positioned between the slider and the armature, wherein the slider is configured to be pressed against the deformable force transfer element to actuate the armature with a press force, and wherein the deformable force transfer element is configured to deform when a press force threshold value is exceeded to limit a transferable force from the slider onto the armature;

wherein the deformable force transfer element comprises a deformable tongue, wherein the slider is configured to be pressed against the deformable tongue, and wherein the deformable tongue is configured to deform when the press force threshold value is exceeded to absorb the press force of the slider;

wherein the deformable force transfer element is surrounded by a circumferential frame that is fixed to the armature, wherein a window is formed in the circumferential frame, and wherein the deformable tongue is mounted on one side on the circumferential frame and a deformation of the deformable force transfer element is absorbed at least partially by the window.

2. The electromagnetic switch according to claim 1, wherein the deformable force transfer element is connected to the armature.

3. The electromagnetic switch according to claim 1, wherein the deformable force transfer element is plastically or elastically deformed.

4. The electromagnetic switch according to claim 1, wherein the deformable tongue is formed by a partial surrounding slit from a piece of material, wherein the circumferential frame surrounds the partial surrounding slit, and wherein the deformable tongue is cut free from the piece of material by the partial surrounding slit and protrudes from a plane of the piece of material.

5. The electromagnetic switch according to claim 1, wherein the deformable tongue comprises a wave form, and wherein a wave flank of the deformable tongue is configured to be impinged by the slider.

6. The electromagnetic switch according to claim 1, wherein the press force threshold value is based at least in part on a geometrical form of the deformable tongue.

7. The electromagnetic switch according to claim 1, wherein the deformable force transfer element is configured to transfer the press force from the slider to the armature to actuate the armature when the press force does not exceed the press force threshold value.

8. The electromagnetic switch according to claim 1, further comprising:

an electromechanical contact configured to freely release in a non-locked contact state, wherein the electromechanical contact is released by the armature by a releasing force applied by the slider on the deformable force transfer element, and wherein the press force threshold value is greater than the releasing force.

9. The electromagnetic switch according to claim 8, wherein the electromechanical contact in a locked state is not released by the releasing force, and wherein the deformable force transfer element is configured to prevent a release of the electromechanical contact in the locked state by using deformation.

10. The electromagnetic switch according to claim 9, wherein the deformable force transfer element is configured to prevent a plastic deformation of electromagnetic switch components by limiting a contact force to a contact force threshold.

11. The electromagnetic switch according to claim 1, wherein the deformable force transfer element is configured to prevent a break of the slider due to mechanical overload by using deformation.

12. The electromagnetic switch according to claim 1, wherein the deformable force transfer element is formed as a single piece.

13. The electromagnetic switch according to claim 1, wherein the electromagnetic switch is a relay.

14. The electromagnetic switch according to claim 1, further comprising a plurality of contacts configured such that opening a contact of the plurality of contacts causes another contact of the plurality of contacts to close.

15. The electromagnetic switch according to claim 2, wherein the deformable force transfer element is materially or frictionally connected to the armature.

16. The electromagnetic switch according to claim 9, wherein the locked state comprises an overcurrent-induced welding of the electromechanical contact in a closed position.

17. The electromagnetic switch according to claim 10, wherein the electromagnetic switch components comprise contact springs.

18. The electromagnetic switch according to claim 12, wherein the deformable force transfer element is formed from metal.

* * * * *